US007248226B2

(12) United States Patent
Yuanzhu

(10) Patent No.: US 7,248,226 B2
(45) Date of Patent: Jul. 24, 2007

(54) COMPACT ANTENNA DEVICE RADIATING CIRCULARLY POLARIZED WAVE

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 15 days.

(21) Appl. No.: 11/337,213

(22) Filed: Jan. 20, 2006

(65) Prior Publication Data

US 2006/0164314 A1 Jul. 27, 2006

(30) Foreign Application Priority Data

Jan. 25, 2005 (JP) ..... 2005-017137

(51) Int. Cl.
*H01Q 13/10* (2006.01)

(52) U.S. Cl. ..... 343/767; 343/770

(58) Field of Classification Search ..... 343/767
See application file for complete search history.

(56) References Cited

U.S. PATENT DOCUMENTS 7,136,024 B2 * 8/2005 Yuanzhu et al. ..... 343/767
2002/0000943 A1 * 1/2002 Oberschmidt et al. ..... 343/767
2003/0112198 A1 * 6/2003 Wang et al. ..... 343/770
2003/0174095 A1 * 9/2003 Sievenpiper ..... 343/770
2005/0104793 A1 * 5/2005 Yuanzhu ..... 343/770
2006/0077113 A1 * 4/2006 Yuanzhu ..... 343/770
2006/0132373 A1 * 6/2006 Yuanzhu ..... 343/767

FOREIGN PATENT DOCUMENTS

JP 2004-194218 7/2004

* cited by examiner

*Primary Examiner*—Trinh Vo Dinh
(74) *Attorney, Agent, or Firm*—Brinks Hofer Gilson & Lione

(57) ABSTRACT

In an antenna device, a radiation slot formed in a metal plate includes a main slot part on one diagonal line of the metal plate and first and second branch slot parts. The first and second branch split parts extend along two adjacent sides of the metal plate and are connected to one end of the main slot part. A power feeder line and a ground line are formed in the vicinity of another end of the main slot part. The length and relative position of each slot part is set such that the plane of polarization of an electric wave radiated from the main and first slot parts and the plane of polarization of an electric wave radiated from the main and second slot parts are orthogonal to each other and the two electric waves differ in phase by 90 degrees.

6 Claims, 5 Drawing Sheets

COMPACT ANTENNA DEVICE RADIATING CIRCULARLY POLARIZED WAVE

BACKGROUND OF THE INVENTION

1. Field of the Invention

The present invention relates to an antenna device with a slot antenna structure and, more particularly, to a compact antenna device that radiates a circularly polarized wave.

2. Description of the Related Art

As a circularly polarized antenna with a slot antenna structure, in the related art, there has been proposed an antenna device provided with a two-point power feeding scheme in which a pair of radiation slots, which are equal in length and perpendicular to each other, is excited by feeding power to each of the radiation slots and electric waves radiated from the radiation slots differ in phase by 90 degrees. However, there is a problem in that the above-mentioned antenna device with the two-point power feeding scheme needing a 90-degree phase difference circuit or the like requires a complex circuit configuration.

Recently, there has been proposed an antenna device provided with a one-point power feeding scheme in which an L-shaped radiation slot, which is formed by connecting the respective one ends of first and second slot parts that are arranged spatially perpendicularly to each other, is formed on a conductor plate, and power is fed to a predetermined position in the vicinity of an edge of the radiation slot so that electric waves radiated from the two slot parts differ in phase by 90 degrees (for example, see JP-A-2004-194218 (page 6, FIG. 7)).

The above-mentioned conventional antenna device has an advantage in that it requires a simple circuit configuration since it employs the one-point power feeding scheme. However, when the wavelength of the electric wave is λ, the length of each of the first and second slot parts is about λ/2, such that one side of a conductor plate provided with an L-shaped radiation slot should be more than λ/2 in length. Accordingly, when an operating frequency is, for example, 2.4 GHz, the antenna device needs a conductor plate with an L-shaped radiation slot whose one side is more than 6 cm in length, such that it is difficult to reduce the size of the antenna device.

SUMMARY OF THE INVENTION

The invention has been finalized in view of the drawbacks inherent in the conventional antenna, and it is an object of the invention to provide a compact circularly polarized slot antenna device with a one-point power feeding scheme.

According to an aspect of the invention, there is provided an antenna device including a radiation slot that is formed in a conductor member and has: a main slot part that is extended straight and has a power feeder part in the vicinity of its one end; and first and second branch slot parts that are extended straight on both sides of the main slot part that is interposed between the first and second branch slot parts, the first branch slot part being connected to the other end of the main slot part and the second branch slot part being connected to the vicinity of the other end of the main slot part, in which a plane of polarization of an electric wave radiated from the main slot part and the first branch slot part is orthogonal to a plane of polarization of an electric wave radiated from the main slot part and the second branch slot part, and the length and the relative position of each slot part are set such that the two electric waves differ in phase by 90 degrees.

The radiation slot of the antenna device thus configured can be considered as a combination of a first V-shaped slot, which is formed by the main slot part and the first branch slot part, and a second V-shaped slot, which is formed by the main slot part and the second branch slot part. In addition, the plane of polarization of an electric wave radiated from the first V-shaped slot and the plane of polarization of an electric wave radiated from the second V-shaped slot are orthogonal to each other and the two electric waves differ in phase by 90 degrees. Accordingly, when the amplitudes of both of the electric waves are set to be equal to each other, it is possible to radiate a circularly polarized wave having a high axial ratio performance. That is, the antenna device can act as a circularly polarized slot antenna with a one-point power feeding scheme that has a simple configuration. In addition, when the antenna device radiates an electric wave with a wavelength of λ, the sum of the length of the main slot part and the length of the first branch slot part (or the second branch slot part) is preferably set to be about λ/2. Accordingly, since the radiation slot can be formed on a small-sized conductor member whose one side is much shorter than λ/2, it is possible to reduce the size of the antenna device.

In the above configuration, when the length of the second branch slot part is less than that of the first branch slot part, the length of the second V-shaped slot becomes a little shorter than that of the first V-shaped slot, resulting in a phase difference of 90 degrees.

In the above configuration, when an angle between the main slot part and the first branch slot part is approximately 45 degrees, and an angle between the main slot part and the second branch slot part is approximately 45 degrees, an angle between the first branch slot part and the second branch slot part, which are provided on both sides of the main slot part interposed therebetween, is approximately 90 degrees. Thus, it is possible to compactly arrange the slot parts. In this case, when the conductor member has a roughly square outer shape in plan view, the main slot part may be formed on one diagonal line of the square. Accordingly, since the first and second branch slot parts can be provided along two adjacent sides of the square, it is possible to obtain a compact antenna device that has a good space factor.

In addition, in the above configuration, the conductor member may be made of a metal plate or a metal film. When the conductor member is made of a metal plate, it is possible to make an antenna device with only sheet metal. Accordingly, it is possible to significantly reduce the production cost.

Further, in the above configuration, when the conductor member is made of a metal film formed on a dielectric substrate, it is possible to reduce the size of the entire device due to the wavelength reduction effect by the dielectric substrate.

The antenna device according to the invention can act as a circularly polarized slot antenna with a one-point power feeding scheme that has a simple configuration, since the length and relative position of each slot part of the radiation slot provided in the conductor member is properly selected such that the plane of polarization of an electric wave radiated from the main slot part and the first branch slot part and the plane of polarization of an electric wave radiated from the main slot part and the second branch slot are orthogonal to each other and the two electric waves differ in phase by 90 degrees. In addition, the antenna device is preferably configured such that the sum of the length of the main slot part and the length of the first branch slot part (or the second branch slot part) is set to be about a half of the wavelength of the electric wave. Accordingly, since the radiation slot can be formed on a small-sized conductor member, it is possible to reduce the size of the antenna device.

DESCRIPTION OF THE PREFERRED EMBODIMENT

Figure 1:
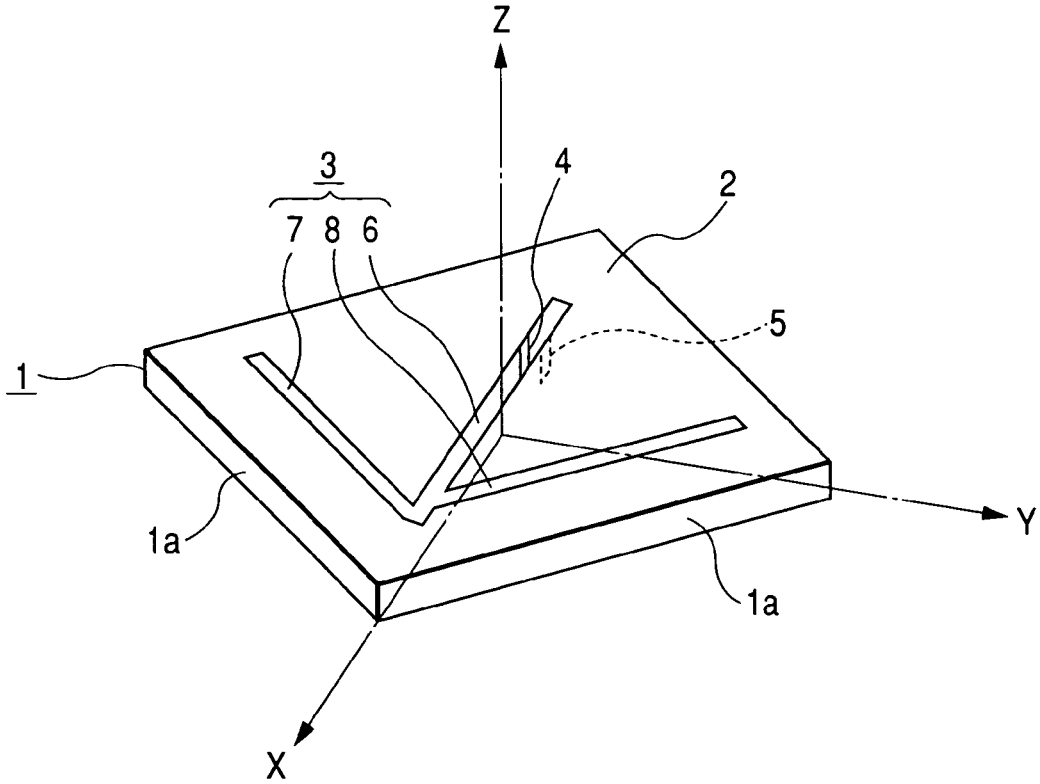
FIG. 1 is a perspective view of an antenna device according to a first embodiment of the invention.
Figure 2:
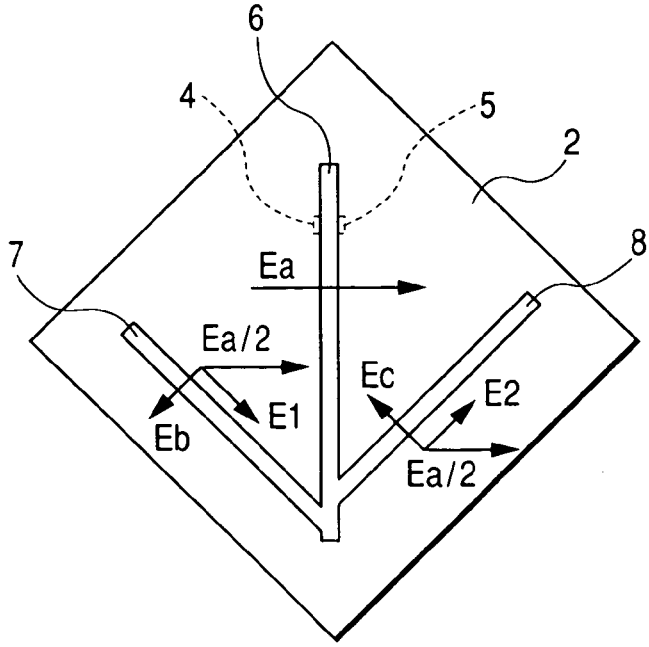
FIG. 2 is a plan view of the antenna device.
Figure 3:
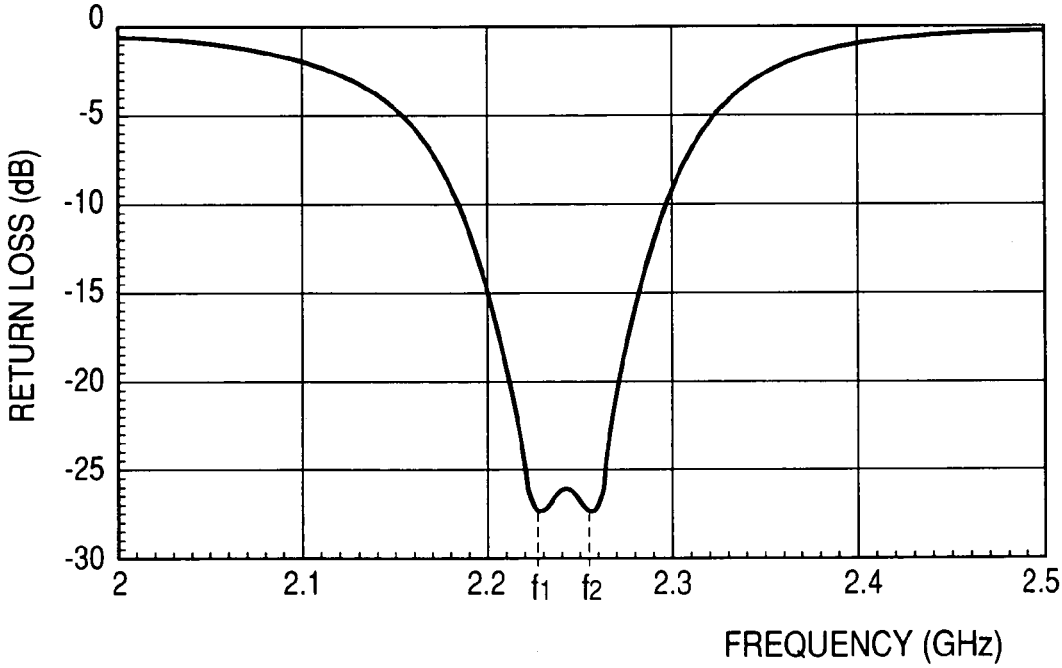
FIG. 3 is a characteristic diagram showing the return loss of the antenna device.

Preferred embodiments of the invention will now be described with reference to the drawings. FIG. 1 is a perspective view of an antenna device according to a first embodiment of the invention. FIG. 2 is a plan view of the antenna device. FIG. 3 is a characteristic diagram showing the return loss of the antenna device. FIG. 4 is a characteristic diagram showing a radiation pattern of the antenna device.

The antenna device shown in FIGS. 1 and 2 includes a box-shaped metal case 1 whose ceiling plate is made of a square metal plate 2, a radiation slot 3, which is formed in the metallic plate 2, a power feeder line 4 and a ground line 5, which extend downward from a power feed position of the radiation slot 3. The radiation slot 3 is configured such that three slots 6, 7, and 8 extend straight and are connected to one another.

The metal case 1 is formed by pressing sheet metal. The metal case 1 is formed in a box shape by bending downward four side portions 1*a* elongated from each side of the metal plate 2. The metal case 1 is provided on a circuit board (not shown) that includes a high-frequency circuit such as a power feeder circuit.

The radiation slot 3 is formed by punching through the metal plate 2 in a predetermined shape. The radiation slot 3 includes a main slot part 6, which is formed along a diagonal line of the metal plate 2, and first and second branch slot parts 7 and 8, which are provided with the main slot part 6 interposed therebetween on both sides of the main slot part 6 interposed therebetween and extend along two adjacent sides of the metal plate 2. The power feeder line 4 and the ground line 5 are provided in the vicinity of one end of the main slot part 6. The vicinity of the other end of the main slot part 6 is connected to one end of the first branch slot part 7. An angle between both of the slot parts 6 and 7 is set to 45 degrees. In addition, the other end of the main slot part 6 is connected to one end of the second branch slot part 8. An angle between both of the slot parts 6 and 8 is also set to 45 degrees. The length of the main slot part 6 is equal to about $\sqrt{2}$ times the length of the first branch slot part 7. The length of the second branch slot part 8 is equal to or a little shorter than the length of the first branch slot part 7. Accordingly, the length of a first V-shaped slot, which is formed by the main slot part 6 and the first branch slot part 7, is a little different from the length of a second V-shaped slot, which is formed by the main slot part 6 and the second branch slot part 8. However, the length difference is not so large, and the length of the V-shaped slot is set to about a half of a wavelength $\lambda$ of the radiated electric wave.

The radiation slot 3 may be considered as a combination of the first V-shaped slot, which is formed by the slot parts 6 and 7, and the second V-shaped slot, which is formed by the slot parts 6 and 8. The length, relative position, and power feed position of each of the slot parts 6, 7, and 8 are properly selected such that electric fields represented in vectors in FIG. 2 are generated when the slot parts are excited. That is, in FIG. 2, symbol Ea represents an electric field generated in the main slot part 6, Eb represents an electric field generated in the first branch slot part 7, and Ec represents an electric field generated in the second branch slot part 8. A composite vector of Ea/2 and Eb becomes an electric field E1 of the first V-shaped slot, and a composite vector of Ea/2 and Ec becomes an electric field E2 of the second V-shaped slot. As shown in FIG. 2, the electric fields E1 and E2 are orthogonal in direction to each other, and are almost equal in magnitude to each other. In addition, since the first V-shaped slot and the second V-shaped slot are different in length from each other, the electric fields E1 and E2 are out of phase from each other. However, the length of each V-shaped slot is set such that the phase difference is 90 degrees.

As shown in FIG. 1, the power feeder line 4 and the ground line 5 are metal pieces formed by bending downward elongated parts of the metal plate 2 from two portions in the vicinity of one end of the main slot part 6. Lower portions of the elongated parts are soldered to the circuit board. That is, the lower portion of the power feeder line 4 is connected to the power feeder circuit, and the lower portion of the ground line 5 is connected to the ground.

In the above-mentioned antenna device, power is fed to the radiation slot 3 so that the first V-shaped slot, which is formed by the main slot part 6 and the first branch slot part 7, and the second V-shaped slot, which is formed by the main slot part 6 and the second branch slot part 8, can be simultaneously excited. In addition, a plane of polarization of an electric wave (electric field E1) radiated from the first V-shaped slot and a plane of polarization of an electric wave (electric field E2) radiated from the second V-shaped slot are orthogonal to each other, the two electric waves differ in phase by 90 degrees, and the amplitudes of the two electric waves are almost equal to each other. Accordingly, the radiation slot 3 generally radiates a circularly polarized wave. That is, the antenna device acts as a circularly polarized slot antenna with a one-point power feeding scheme that has a simple configuration.

Figure 4A:
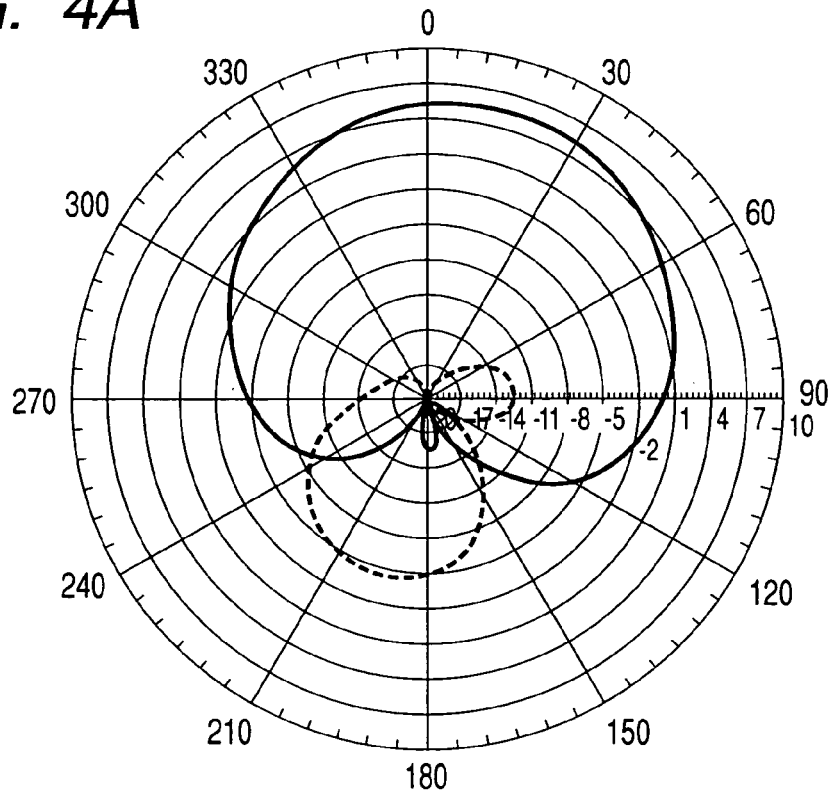
FIG. 4 is a characteristic diagram showing a radiation pattern of the antenna device.
Figure 4B:
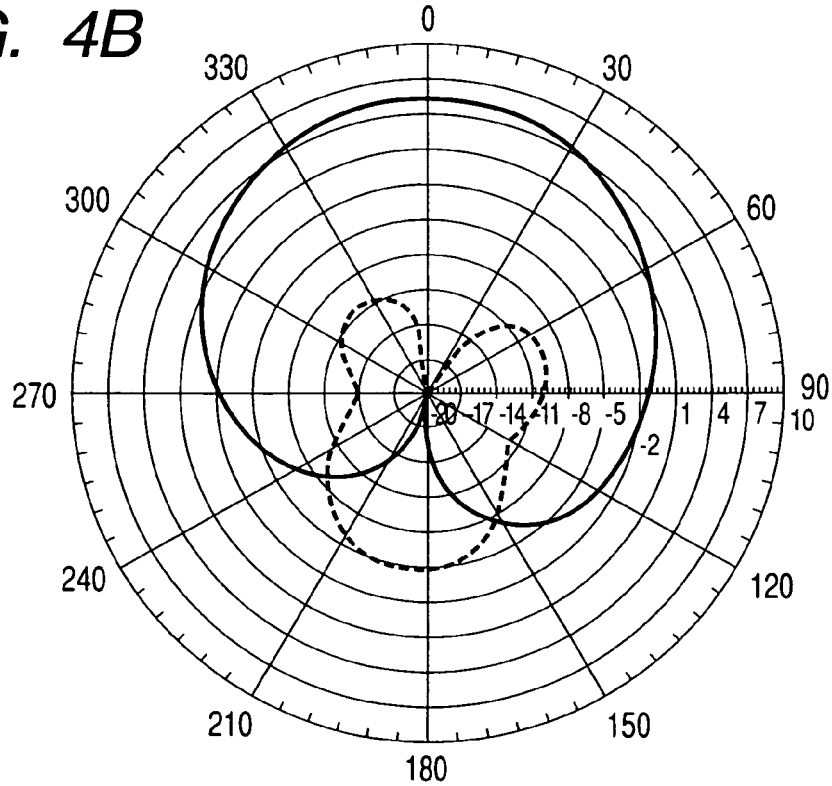

The return loss (S11) with respect to a frequency of the antenna device varies as shown in FIG. 3. In FIG. 3, f1 represents a resonance frequency of the first V-shaped slot, and f2 represents a resonance frequency of the second V-shaped slot. When XYZ-axes are determined as shown in FIG. 1, a YZ-plane radiation pattern of the antenna device is shown in FIG. 4A, and a XZ-plane radiation pattern is shown in FIG. 4B. However, in FIGS. 4A and 4B, a curved line depicted in a solid line represents LHCP (Left Handed Circular Polarization), and a curved line depicted in a dotted line represents RHCP (Right Handed Circular Polarization). As can be seen from FIG. 4, the antenna device can obtain a radiation pattern in which the gain of the circularly polarized wave (in this case, LHCP) is high in a wide angle range in the zenith direction of the metal plate 2, and which is easy to use.

The antenna device is configured such that the radiation slot 3 is compactly formed in the square metal plate 2 whose one side is λ/3 of length since the length of each V-shaped slot is preferably set to about λ/2 when the wavelength of the radiated electric wave is equal to λ. Thus, when the operating frequency is, for example, 2.2 GHz, the antenna device can be configured such that the radiation slot 3 is formed in the metal plate 2 whose one side is about 4.5 cm in length, thereby reducing the size of the antenna device. When the antenna device is applied to wireless communication in which the operating frequency is 2.4 GHz, the radiation slot 3 can be formed in the metal plate 2 whose one side is about 4.2 cm in length. When the antenna device is applied to an ETC (electronic toll collections system or automatic fare collection system) in which the operating frequency is 5.8 GHz, the radiation slot 3 can be formed in the metal plate 2 whose one side is about 1.7 cm in length.

In addition, since the antenna device uses the power feeder line 4 and the ground line 5, which are made of metal pieces elongated from the metal plate 2, as a power feeding means of the radiation slot 3, it is possible to form the antenna device including the power feeding unit by only sheet metals. Accordingly, it is possible to manufacture the antenna device at a very low price.

Figure 5:
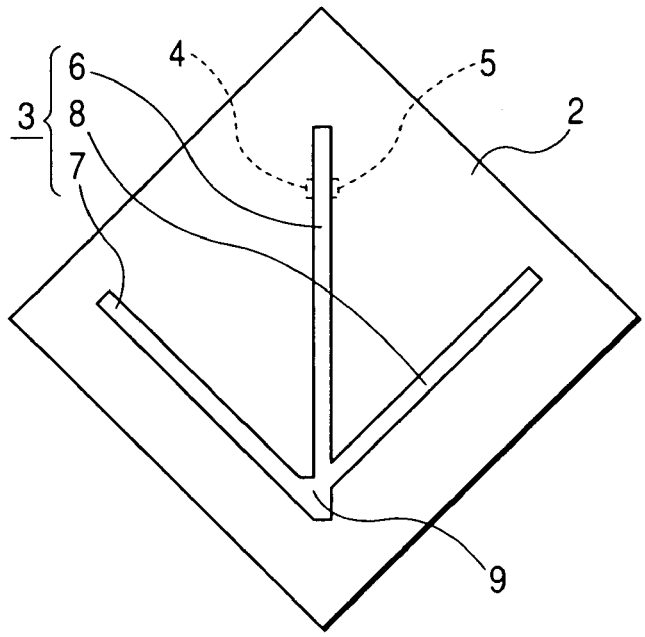
FIG. 5 is a plan view of an antenna device according to a second embodiment of the invention.
Figure 6:
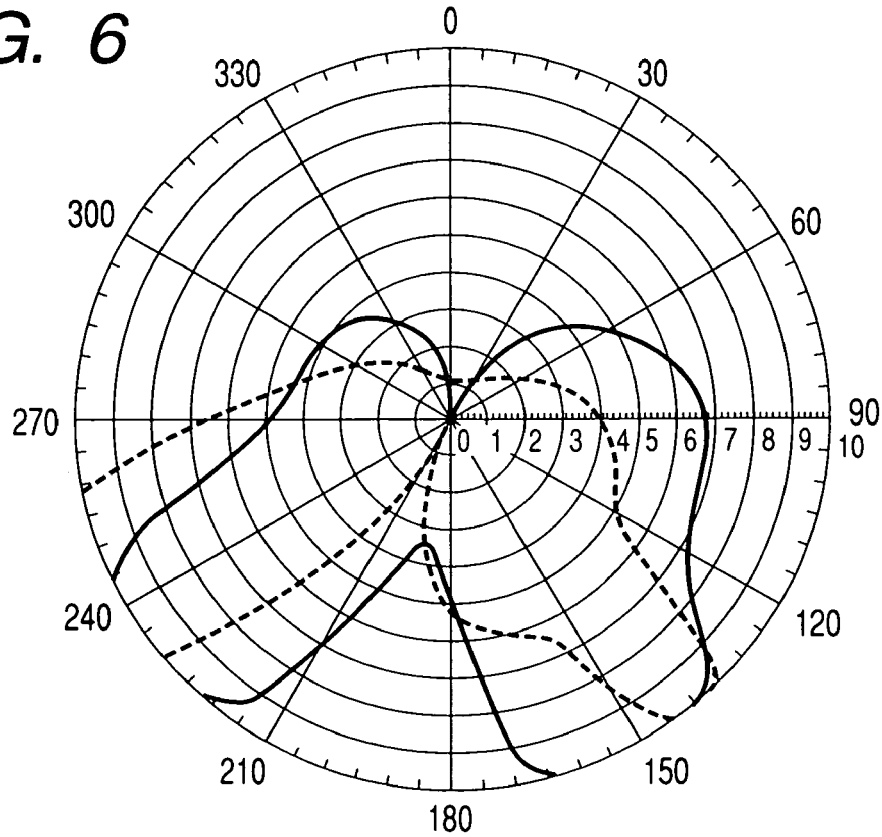
FIG. 6 is a characteristic diagram showing an axial ratio pattern of the antenna device.

FIG. 5 is a plan view of an antenna device according to a second embodiment of the invention. FIG. 6 is a characteristic diagram showing an axial ratio pattern of the antenna device. In FIG. 5, components corresponding to those of FIG. 2 are depicted by the same reference numerals and a detailed description thereof will thus be omitted herein.

The antenna device shown in FIG. 5 is configured such that a wide portion 9 is formed at a connection part between the main slot part 6 and the first branch slot part 7 such that more current flows to the first branch slot part 7 than to the second branch slot part 8. That is, since the first V-shaped slot, which is formed by the main slot part 6 and the first branch slot part 7, is a little longer than the second V-shape slot, which is formed by the main slot part 6 and the second branch slot part 8, the current tends to flow into the second V-shaped slot more than into the first V-shaped slot due to the difference of the impedance. In this case, since the electric field E1 of the first V-shaped slot becomes lower than the electric field E2 of the second V-shaped slot, an axial ratio performance may be deteriorated. Thus, in the present embodiment, the wide portion 9 is formed in the radiation slot 3 such that the current is likely to flow into the first branch slot part 7. As a result, almost the same amount of current flows into each of the branch slot parts 7 and 8, and the electric fields E1 and E2 are nearly equal in magnitude to each other. Accordingly, the antenna device can obtain a high axial ratio pattern as shown in FIG. 6. In FIG. 6, a curved line depicted in a solid line represents an axial ratio pattern of the XZ-plane, and a curved line depicted in a dotted line represents an axial ratio pattern of the YZ-plane.

Figure 7:
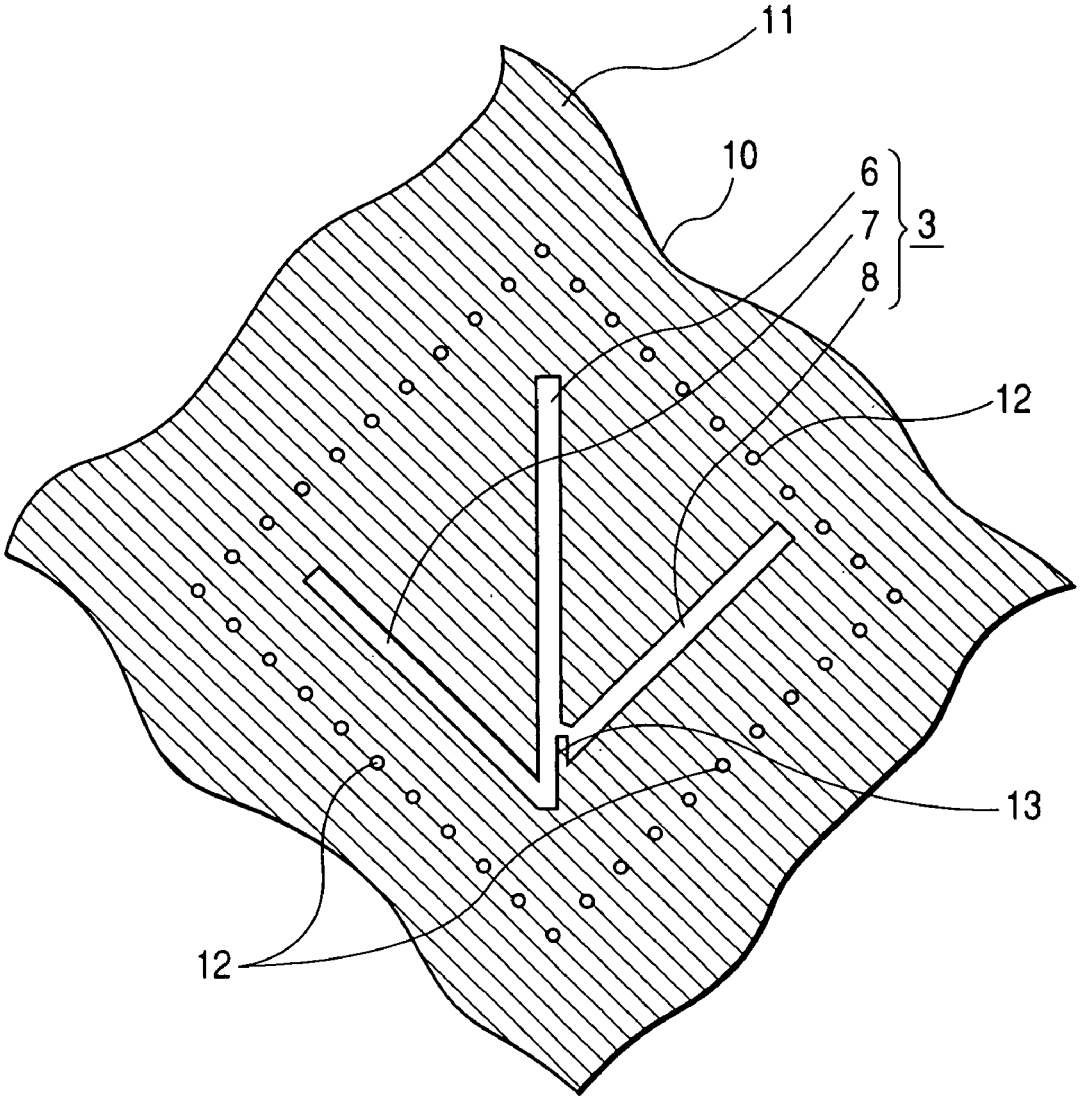
FIG. 7 is a plan view of an antenna device according to a third embodiment of the invention.

FIG. 7 is a plan view of an antenna device according to a third embodiment of the invention. Components corresponding to those of FIGS. 2 and 5 are depicted by the same reference numerals and a detailed description thereof will thus be omitted herein.

The antenna device shown in FIG. 7 is different from that of the first or second embodiment in that the radiation slot 3 is provided in a metal film 11 on a dielectric substrate 10 rather than in the metal plate. The metal film 11 is connected to the ground (not shown) through a plurality of via holes 12. In addition, a notch portion 13 is formed to narrow the connection part between the main slot part 6 and the second branch slot part 8.

According to the third embodiment, it is possible to further reduce the size of the antenna device due to the wavelength reduction effect by the dielectric. In addition, since the notch portion 13 is formed to narrow the connection part between the main slot part 6 and the second branch slot part 8 such that the current flowing into the second branch slot part 8 is reduced, it is possible to improve the axial ratio performance by making almost the same amount of current flow into each of the branch slot parts 7 and 8.

The invention claimed is:

1. An antenna device comprising a radiation slot that is formed in a conductor member and includes:

a main slot part that is extended straight and has a power feeder part in the vicinity of one end; and first and second branch slot parts that are extended straight on both sides of the main slot part that is interposed between the first and second branch slot parts, the first branch slot part being connected to another end of the main slot part opposing the one end and the second branch slot part being connected to the vicinity of the other end of the main slot part, wherein a plane of polarization of an electric wave radiated from the main slot part and the first branch slot part is orthogonal to a plane of polarization of an electric wave radiated from the main slot part and the second branch slot part, and a length and relative position of each slot part is set such that the two electric waves differ in phase by 90 degrees.

2. The antenna device according to claim 1, wherein the length of the second branch slot part is less than that of the first branch slot part.

3. The antenna device according to claim 1, wherein an angle between the main slot part and the first branch slot part is approximately 45 degrees, and an angle between the main slot part and the second branch slot part is approximately 45 degrees.

4. The antenna device according to claim 3, wherein the conductor member has a roughly square outer shape in plan view, and the main slot part is formed on one diagonal line of the square.

5. The antenna device according to claim 1, wherein the conductor member is made of a metal plate.

6. The antenna device according to claim 1, wherein the conductor member is made of a metal film formed on a dielectric substrate.

* * * * *